United States Patent [19]

Folsom et al.

[11] 4,011,790

[45] Mar. 15, 1977

[54] RECOIL CONVERTER FOR SELF POWERED GUN

[75] Inventors: Lawrence Ray Folsom, Schenectady, N.Y.; Roger Eugene Gaboriault, Williston, Vt.

[73] Assignee: General Electric Company, Burlington, Vt.

[22] Filed: July 28, 1975

[21] Appl. No.: 600,179

[52] U.S. Cl. ..... 89/162; 89/172

[51] Int. Cl.[2] ..... F41D 3/06

[58] Field of Search ..... 89/162, 161, 172, 174, 89/169

[56] References Cited

UNITED STATES PATENTS

| | | | |
|---|---|---|---|
| 676,995 | 6/1901 | Roth et al. | 89/174 |
| 2,344,109 | 3/1944 | Rossmanith | 89/169 |
| 3,241,448 | 3/1966 | Rocha | 89/161 |
| 3,548,709 | 12/1970 | Prince | 89/161 X |
| 3,667,343 | 6/1972 | Jurkowski et al. | 89/161 |
| 3,757,636 | 9/1973 | Chiabrandy | 89/169 |
| 3,915,058 | 10/1975 | Folsom et al. | 89/172 |

*Primary Examiner*—David H. Brown
*Attorney, Agent, or Firm*—Bailin L. Kuch

[57] ABSTRACT

A gun is provided having an operating mechanism which receives and stores energy from the gun housing during the recoil of the gun and which subsequently utilizes the stored energy in two distinct phases during the counter-recoil of the gun.

10 Claims, 9 Drawing Figures

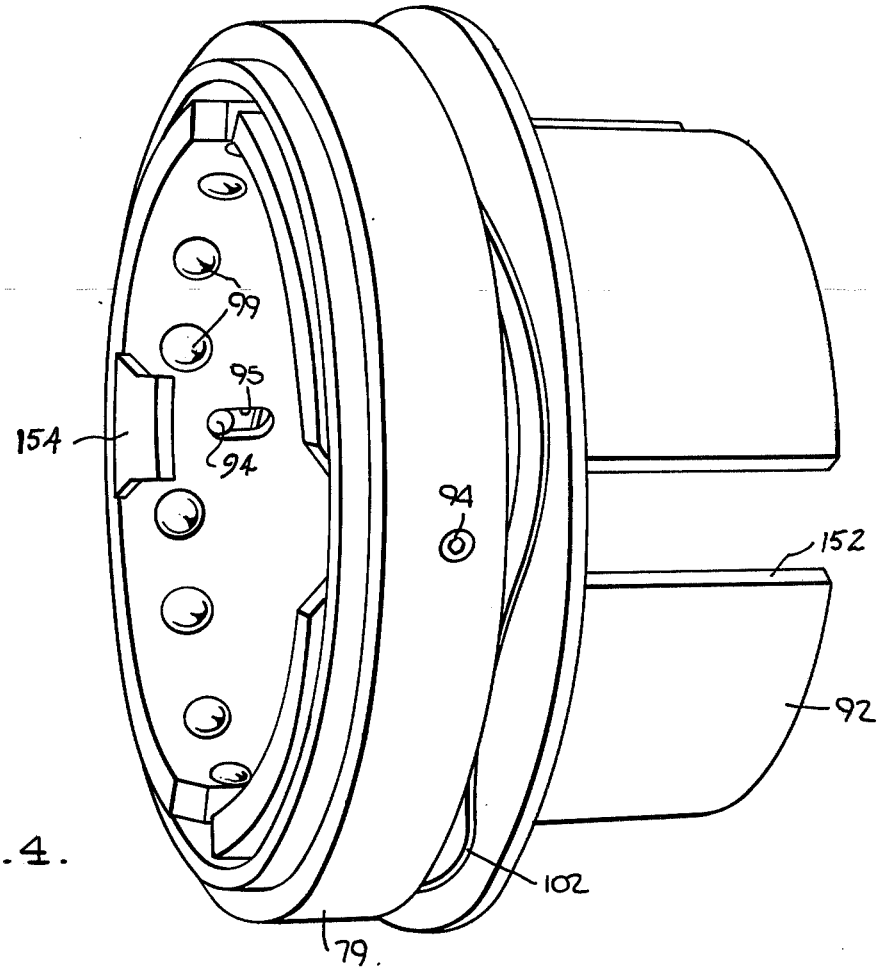
Fig. 4.
Fig. 7.
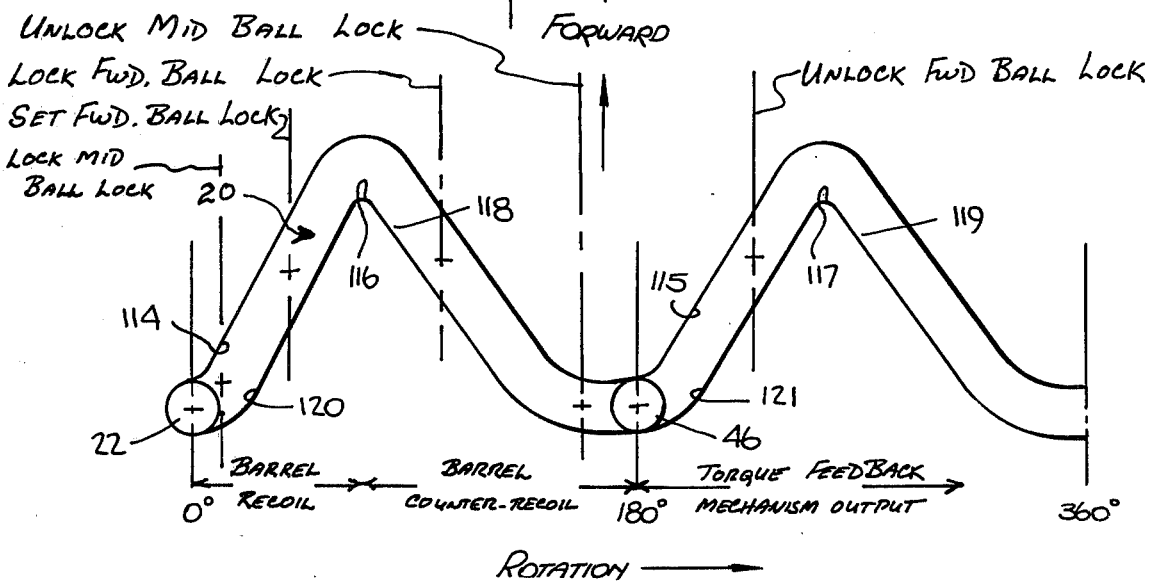

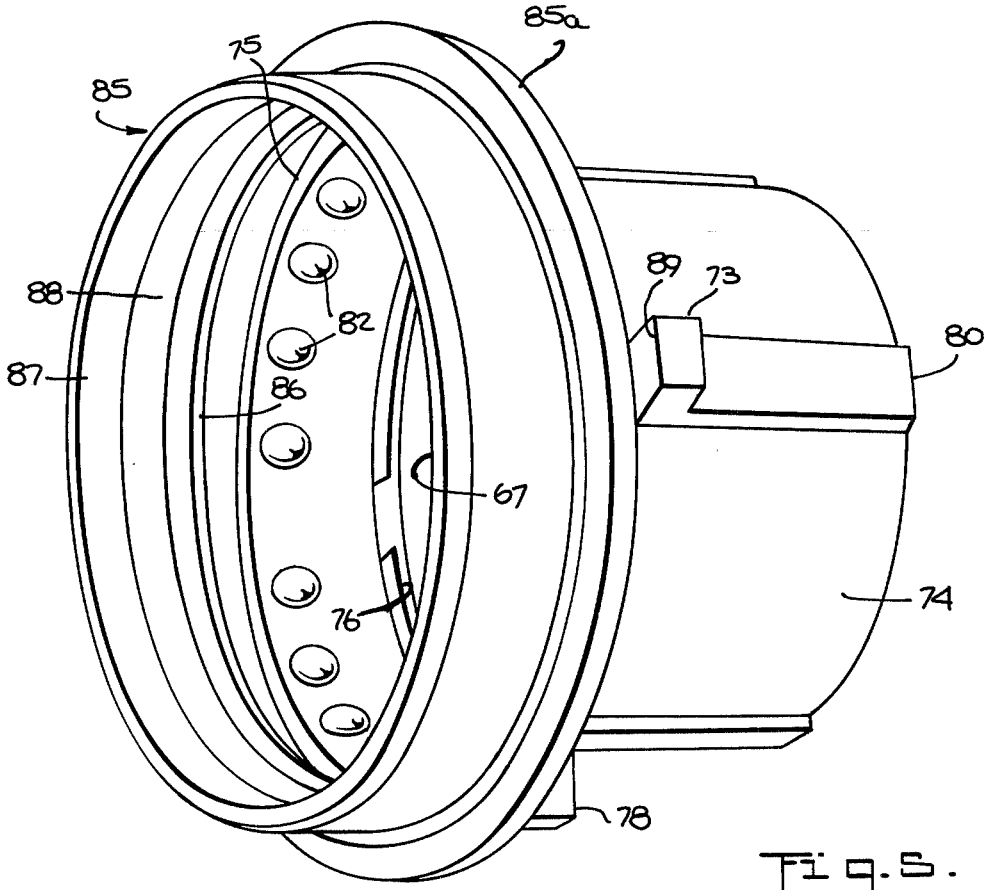
Fig. 5.
Fig. 6.
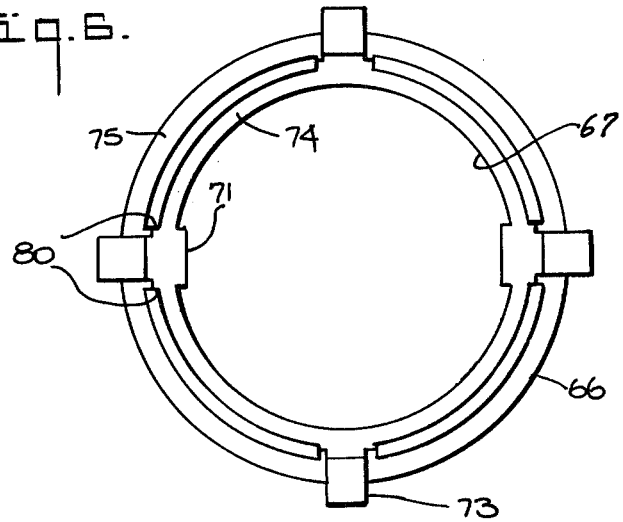

RECOIL CONVERTER FOR SELF POWERED GUN

BACKGROUND OF THE INVENTION

1. Field of the Invention

This invention relates to mechanisms for absorbing the recoil force of guns.

2. Prior Art

In U.S. Pat. No. 3,915,058 filed Oct. 3, 1973, by L. R. Folsom et al., there is disclosed a gun which minimizes peak recoil forces on the trunnions by transferring much of the recoil force during the recoil period of the gun cycle to a rotating operating mechanism. In Ser. No. 498,353, filed Aug. 19, 1974, by L. R. Folsom et al., there is disclosed a feeder mechanism particularly adapted for use with the rotating operating mechanism of U.S. Pat. No. 3,915,058. In Ser. No. 520,858, filed Nov. 4, 1974, there is disclosed a recoil converter mechanism which stores energy during recoil and releases the stored energy during counter-recoil to the rotating operating mechanism of U.S. Pat. No. 3,915,058.

SUMMARY OF THE INVENTION

It is an object of this invention to provide an improved rotating operating mechanism of the type disclosed in U.S. Pat. No. 3,915,058.

A feature of this invention is the provision of a gun having an operating mechanism which receives and stores energy from the recoiling mass during recoil of the gun and which subsequently utilizes the stored energy in two distinct phases during the counter-recoil of the gun.

These and other objects, features, and advantages of the drawing will be apparent from the following specification thereof taken in conjunction with the accompanying drawing in which:

FIG. 1 is a top plan view of a gun having an operating mechanism embodying this invention:

FIGS. 2A, 2B and 2C, taken in conjunction, are a right side view in elevation of the gun of FIG. 1;

FIG. 4 is a perspective view of the rear spring sleeve and the forward ball lock ring shown in FIG. 3;

FIG. 5 is a perspective view of the locking sleeve and the mid ball lock ring shown in FIG. 3;

FIG. 6 is an end view, looking aft, of the locking sleeve of FIG. 3; and

FIG. 7 is a development of the cam track of the forward cam shown in FIG. 3.

DESCRIPTION OF THE PREFERRED EMBODIMENT

Figure 1:
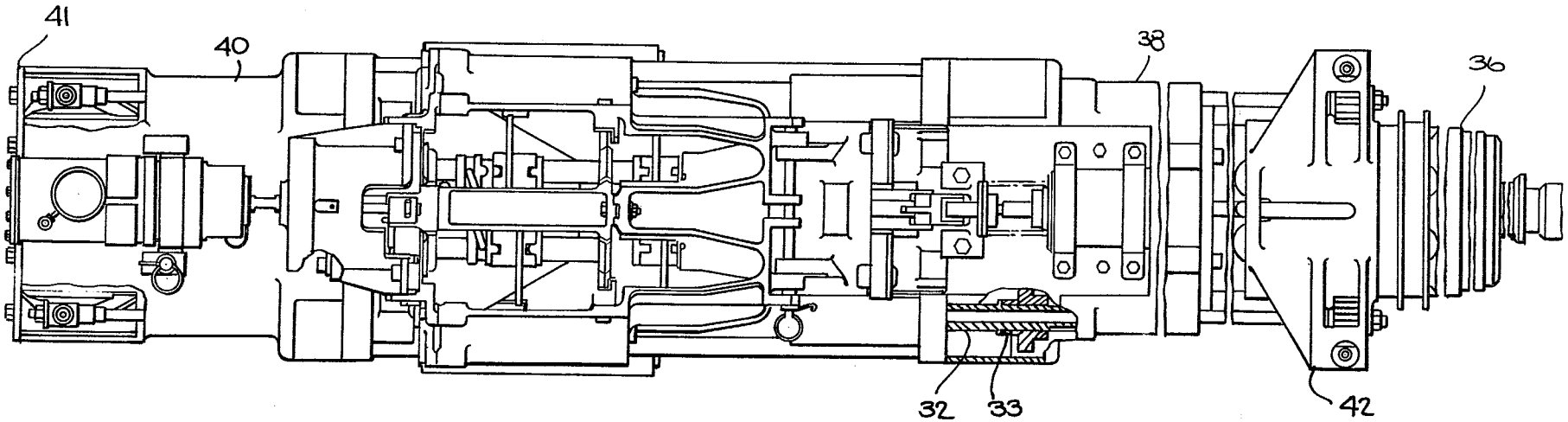
Figure 2A:
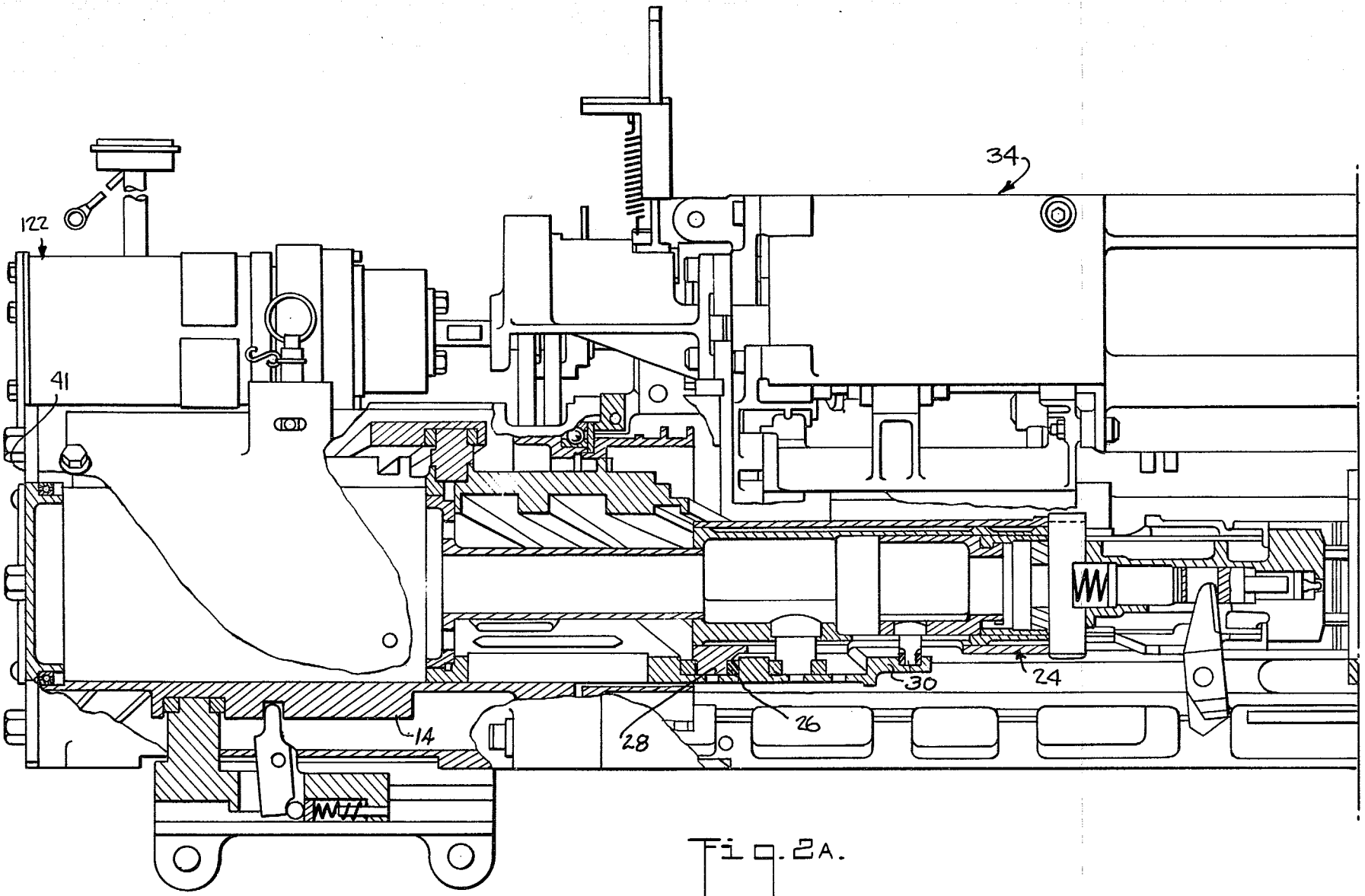
Figure 2B:
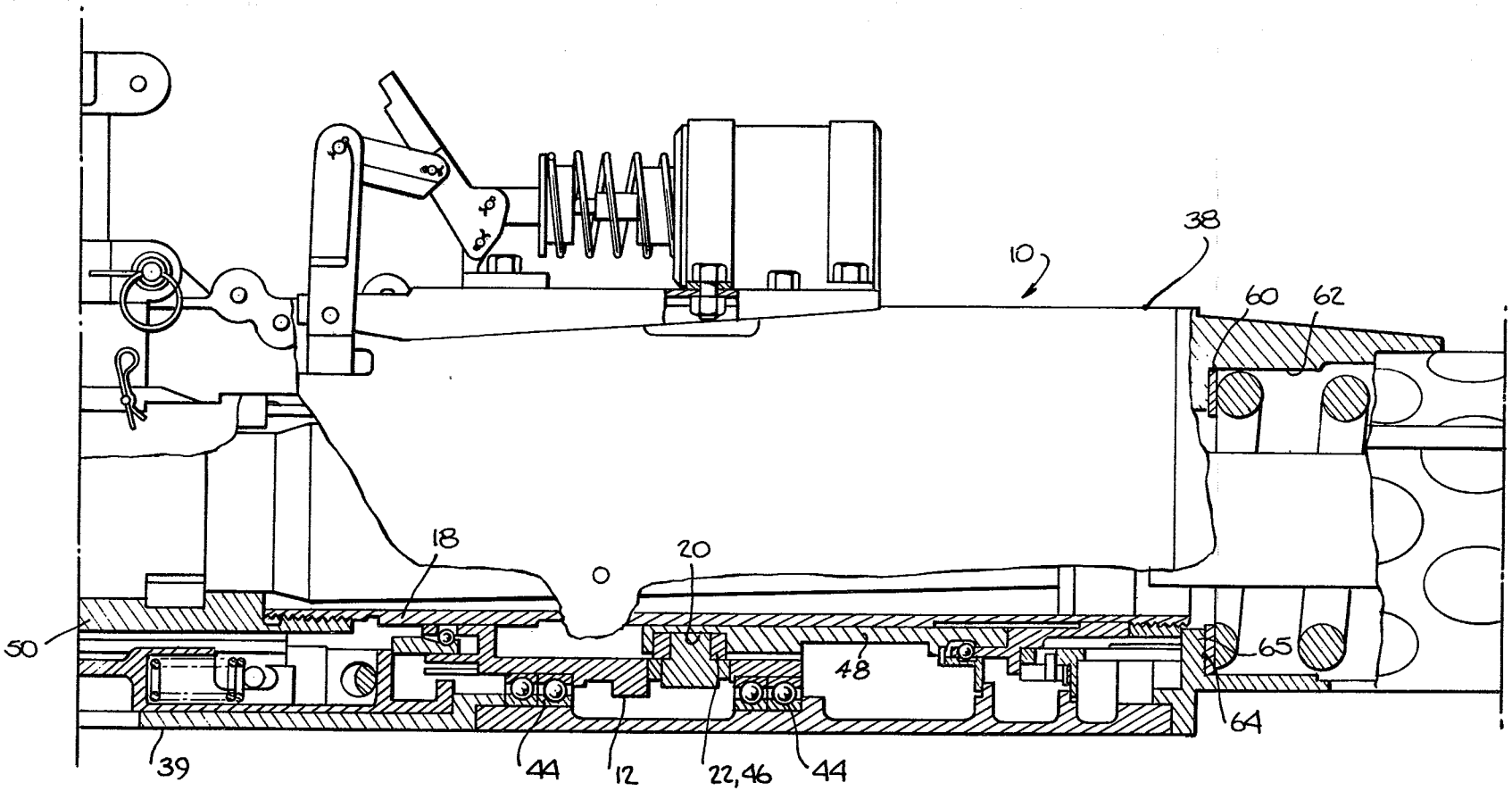
Figure 2C:
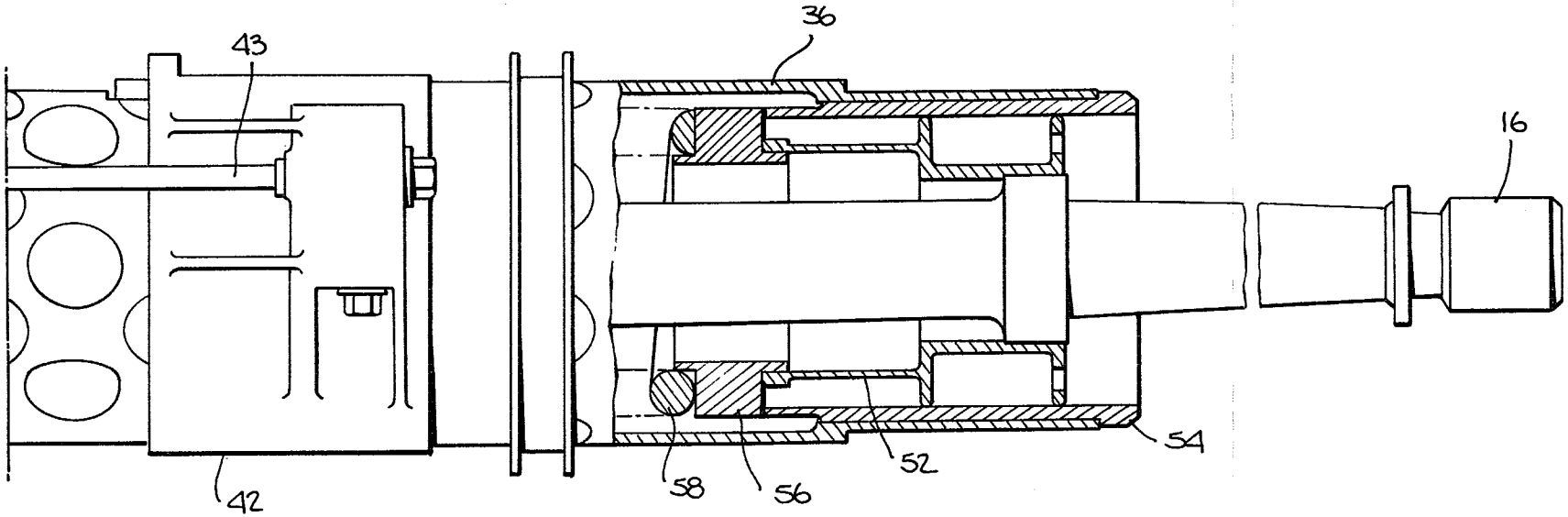

The structure of the gun is similar to that shown progressively in U.S. Pat. No. 3,915,058, Ser. No. 498,353, and Ser. No. 520,858, supra, to which reference should be made for details not herein described.

Briefly recapitulating, the gun includes a housing 10 in which are journaled for rotation a forward rotor 12 and an aft rotor 14. A gun barrel 16 and a fixed thereto barrel extension 18 are journaled for reciprocation in the housing. The barrel extension has slidably mounted thereon a forward cam 48 having a cam track 20 in which ride cam followers 22 and 46 mounted to the forward rotor. A gun bolt assembly 24 is journaled for reciprocation in the housing and has a cam roller 26 which rides in a cam track 28 in a slide 30 which is driven by the aft rotor 14. Recoil of the gun barrel via the cam track and cam rotates the forward rotor, which by a pair of intermediate tubular shafts 32 and spur gears 33 is coupled to and rotates the aft rotor 14, which reciprocates the gun bolt, both of which are on concentric axes. A dual feeder 34 includes an outer pair of right side and left side stripper sprocket assemblies and an inner pair or right side and left side feeder assemblies, of which only one side or the other at any time is effective, to side strip rounds from their links and to laterally hand them off to the face of the gun bolt.

The housing 10 includes a forward gun tube 36, a forward gun housing 38, a mid gun housing 39, an aft gun housing 40, and an aft cover 41. A gun mount 42 is slidably mounted on the gun tube 36 and longitudinally coupled to the housing via a pair of torsion shafts 43 and other mechanisms as shown in Ser. No. 520,858, supra. The forward rotor 12 is journaled for rotation within the housing 10 by four ball bearings 44. The forward rotor 12 carries the pair of cam follower rollers 2046, which ride in the cam track 20 formed in the forward cam 48 which is guided to the barrel extension 18 for reciprocation but not rotation. The gun barrel 16 is fixed to the barrel extension 18. The forward end of the gun barrel is fixed in a barrel stop 52 which slides in a locking ring 54 which is threaded to the forward gun tube 36 and which serves as a forward stop for a spring plate 56 which is carried by the stop 52. The forward end of a helical compression barrel spring 58 abuts the plate 56, while its aft end abuts a spring ring 60 which rides in a bore 62 in the forward housing 38 and which abuts a shoulder 64 on an annular web 65 of the forward housing. Extending radially inward from web 65 are four abutments 63 which pass through slots 150 cut in the forward portion of the forward cam 48 and slots 152 cut in a rear spring sleeve 92, said abutments providing forward stopping surfaces for a lock ring 69 and the barrel extension 18 as hereinafter described.

The forward cam 48 is releasably secured to the barrel extension 18 by means of a mid-ball lock assembly hereinafter described.

A locking sleeve 66 is mounted on the barrel extension 18 by means of an inner bore 67, and said sleeve 66 is fixed axially to the barrel extension by shoulder 68 in cooperation with the lock ring 69 which is threaded onto the barrel extension by threads 70. Locking sleeve 66 is fixed against rotation on barrel extension 18 by means of two key portions 71 which project into slots 72 cut longitudinally in the barrel extension. Extending radially outward from the aft end of the forward tubular portion 74 of the locking sleeve are four projections 73 serving as a spider, which integrally connect the forward tubular portion 74 of the sleeve 66 with a rear tubular portion 75 of the sleeve of a larger diameter. The rear face 76 of the forward tubular portion 74 forms an abutment which is stationary relative to the barrel extension against which a corresponding forward inner step face 77 of the forward cam 48 can bear to force the forward cam 48 aftward when the barrel extension recoils aftwardly. The forward faces 78 of projections 73 form abutments against which a forward ball lock ring 79 can bear. Extending forward of the projections 73 integrally from the outside of the forward tubular portion 74 are external key portions 80 on which ride the slots 150 cut in the forward portion of forward cam 48 to prevent rotation of the cam while permitting translation rearward away from abutment 76.

The rear tubular portion 75 of locking sleeve 66 contains a plurality of radial bores 81 in which are slidably located a like plurality of balls 82. Cut into the cylindrical portion 83 of the forward cam 48 in an annular groove 84 with a depth equal to less than one-half of the diameter of the balls 82, the groove being of such contour that movement of the cam 48 in a rearward direction away from abutment 76 cams the balls 82 radially outward in the bores 81. A mid-ball lock ring 85 is slidably mounted on the outside of the rear tubular portion 75 of the locking sleeve 66. The ring 85 has a longitudinal forward bore 86, the diameter of which is less than the sum of two diameters of balls 82 plus the diameter of groove 84, so that the balls limit the rearward travel of the ring 85 on the locking sleeve 66. The lock ring 85 has a longitudinal rear bore 87 the diameter of which is slightly larger than the sum of two diameters of the balls 82 plus the diameter of the groove 84, and smaller than the sum of two diameters of the balls plus the diameter of cylindrical section 83 of the forward cam 48, so that, when the ring 85 is displaced forwardly on the locking sleeve 66, the bore 87 prevents the balls 82 from being cammed radially outward of groove 84, thereby locking the forward cam 48 to the locking sleeve 66 against relative longitudinal movement. The ball lock ring 85 is also provided with an annular groove 88 disposed between bores 86 and 87, said groove being of sufficient diameter to permit the balls 82 to be cammed radially outward in their bores 81 a distance sufficient to allow the balls to leave the groove 84 and ride onto the external cylindrical surface 83 of the forward cam 48. The mid-ball lock ring 85 is urged forward toward abutments 89 on locking sleeve 66 by a wave washer spring 90 positioned against shoulder 91 of the forward cam 48, thereby locking the forward cam 48 to the locking sleeve 66. At the forward edge of the mid-ball lock ring 85 is a flange 85*a* which is engaged by a circular shoulder 93 on an inwardly extending web in the gun housing 10, said engagement preventing forward motion of the ball lock ring 85 when the barrel extension 18 is in battery position, thereby holding the mid-ball lock in released position, so permitting rearward motion of the cam 48 without corresponding rearward motion of the barrel extension 18.

The cylindrical section 83 of the forward cam 48 provides a sliding support for the rear spring sleeve 92 which is prevented from moving rearward by a web shoulder 93*a* in the gun housing 10 and restrained from forward motion by spring ring 60. The rear most portion of the rear spring sleeve 92 slidably supports the forward ball lock ring 79, the longitudinal travel of which ring is limited by spiral pins 94 fixed to the ring 79 and extending into slots 95 in the rear spring sleeve 92. The forward ball lock ring 79 has two longitudinally aligned bores 96 and 97 which interact with plurality of balls 99 in respective radial bores 98 in the rear spring sleeve 92, the cylindrical surface 83 and a reduced diameter external cylindrical surface 100 in the same manner as the bore 87 and the groove 88 interact with the balls 82 in the bores 81 and the external cylindrical surface 83 and the annular groove 84 to provide a releasable abuting connection between the rear spring sleeve 92 and a shoulder 101 at the aft end of the surface 100 of the forward cam 48. The forward ball lock ring 79 is biased rearwardly on the rear spring sleeve 92 by a wave washer spring 102 to cam the balls 99 into engagement with the shoulder 101 and is driven forward relative to the sleeve 92 by forward faces 78 on projection 73 when the rear spring sleeve 92 is in proximity with the projections 73 on the locking sleeve 66, said condition existing when the mechanism is in firing, or battery, position. Notches 154 are cut in the rear end of the rear spring sleeve 92 to provide clearance for the projections 73.

At the rear of the forward rotor 12 are a plurality of radial bores 103 in which are slidably contained a like plurality of balls 104, the outward radial travels of which are limited by a groove 106 on the inner surface of an aft ball lock ring 105. The diameter of the groove is such that the balls fit loosely between the groove 106 cylindrical section 107 of the barrel extension 18. The rear edge of the groove 106, through contact with the balls 104, prevents the aft ball lock ring 105 from moving forward while the balls are located adjacent to the cylinder surface 107. When the barrel extension 18 moves aft to its full recoil position, a shoulder 108 on an annular groove 156 in the barrel extension passes the radial bores 103, allowing the balls to move radially inward and permitting the lock ring 105 to move forward, bringing camming surface 109 into contact with the balls. A sear yoke 110 and toggle links 111 can then be moved into the seared position by the sear spring 112, in which position toe 158 of the sear holds the lock ring 105 firmly in its forward position and thereby prevents the balls from moving radially outward. Forward motion of the barrel extension 18 is stopped by shoulder 108 contacting the balls 104. Energizing the solenoid 113 breaks the toggle linkage 11, releasing the yoke 110, moving the toe 158 aftwardly away from the lock ring 105. With the lock ring released, shoulder 108 can cam the balls outward in bores 103, and the balls, in turn, press against cam surface 109 to move the lock ring aft. Balls 104 are then free to move outward, releasing the barrel extension.

The rear portion of the forward cam 48 contains the two-lobed cam track 20 which receives the cam followers 22 and 46. The cam track contains camming surfaces 114 and 115, humps 116 and 117, and camming surfaces 118 and 119, as well as camming surfaces 120 and 121, as shown in FIG. 7.

The gun includes an electric charger assembly, shown generally at 122, which is adapted to drive the aft rotor 14 through an overrunning clutch and gear mechanism.

Figure 3:
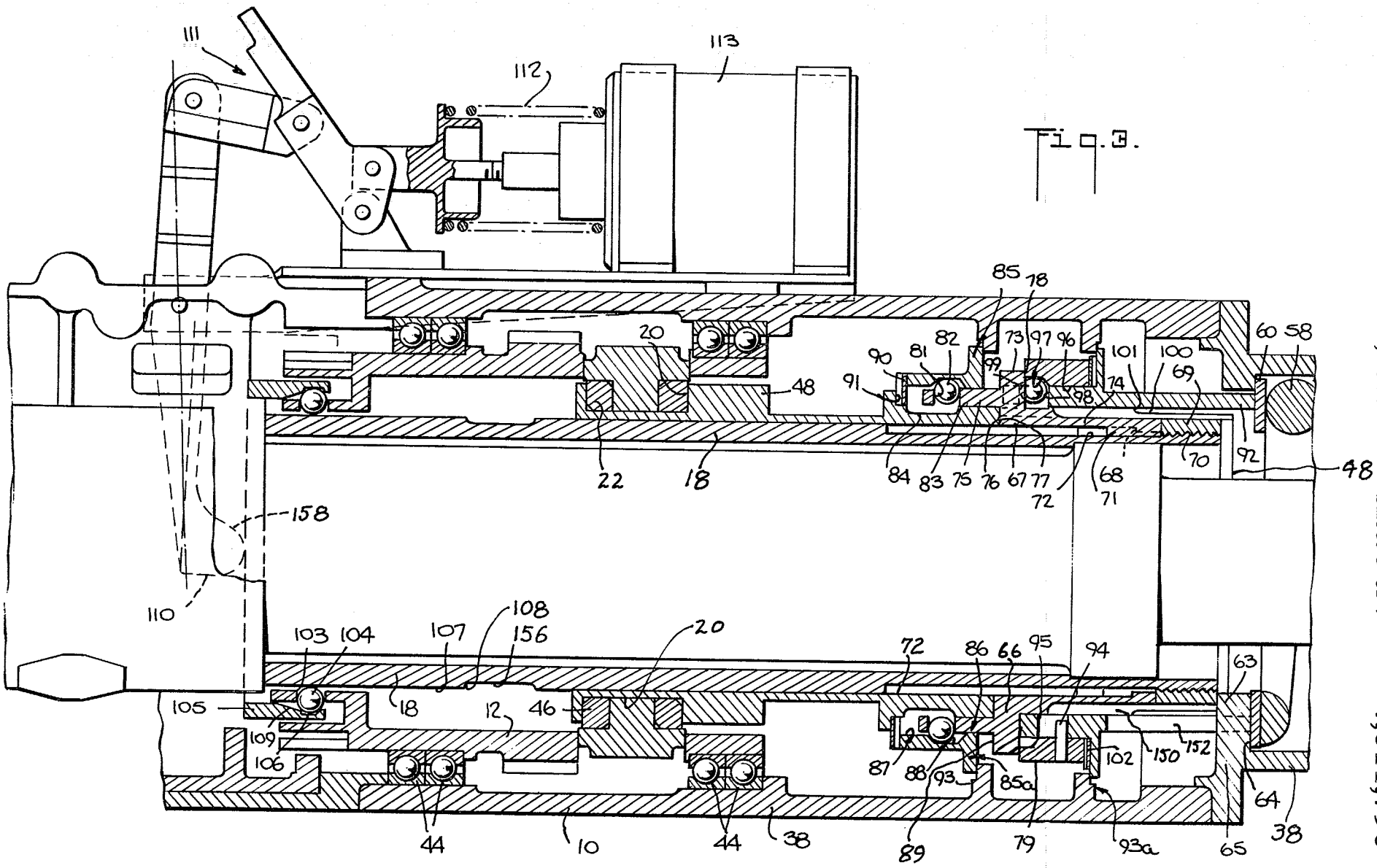
FIG. 3 is a detail of FIG. 2B.

In the assembled but uncharged position of the gun, the components of the gun drive mechanism are in the position shown in FIG. 3. The barrel helical compression spring 58 holds the barrel 16 pushed forward. The barrel, in turn, holds the barrel extension 18 and the locking sleeve 66 in their forward, or battery position: The abutments 78 on the sleeve 66 hold the forward ball lock ring 79 forward against the urging of wave spring 102 so that the rear bore 97 of the forward lock ring is aligned with the balls 99 of the forward ball lock. Similarly, the annular flange 85*a* abuts the housing web shoulder 93, holding the mid-ball lock ring 85 aft against the urging of wave spring 90 so that the annular groove 88 is aligned with the balls 82 of the mid-ball lock. Both of the ball locks are thereby in unlocked position, wherein the balls are free to move radially outwardly to unlock the forward cam 48 from the barrel extension 18.

In said uncharged position, the gun may be cycled, without charging, by the charger assembly 122, which drives the aft rotor 14, which by means of the cam roller 26 and the cam slide 30 drives the bolt 24 through its reciprocation. Through appropriate drive mechanisms, the aft rotor 14 is coupled to one of the stripper sprocket assemblies and the corresponding feed assembly, the motion of said assemblies being synchronized with the reciprocation of the bolt so that cartridges may be sequentially fed to the face of the bolt at the rear dwell of its reciprocation. Through the gears 33 and the tubular shafts 32, the forward rotor 12 and the cam followers 22 and 46 are rotated about the forward cam 48, interacting with the two-lobed cam track 20 and causing cyclical, longitudinal reciprocation of the forward cam 48. Since both the mid-ball lock ring 85 and the forward ball lock ring 79 are in their unlocked positions, balls 82 are free to move outwardly from groove 84 to permit rearward motion of the cam 48 on the barrel extension 18, and the balls 99 are free to move outward from shoulder 101 to permit subsequent forward motion of the cam 48 without moving the rear spring sleeve 92 forwardly against the barrel spring 58. The gun mechanism, therefore, can be cycled freely in the uncharged position.

In order to charge the gun, the solenoid 113 is deenergized; and ammunition is introduced into the stripper sprocket assembly and the gun is cycled as described above by the charger assembly until the first cartridge reaches battery position and is fired. At battery position, the cam followers 22 and 46 of the forward rotor 12 lie slightly beyond 0° and 180° respectively on the cam track 20 of the forward cam 48. Upon firing, the gun barrel 16, the barrel extension 18, and the locking sleeve 66 recoil aft. The abutment 76 strikes surface 77 of the forward cam 48 and drives the cam aft, causing camming surfaces 114 and 115 of the cam track 20 in the forward cam 48 to contact and drive the cam followers 22 and 46 which are journaled to the rotor 12, accelerating the rotation of the forward rotor 12, which correspondingly accelerates the previously described cycling motion of the gun mechanism and causes the gun mechanism to overrun the charger, at which time power to the charger is interrupted by external control means.

As the locking sleeve 66 and the forward cam 48 move aft in recoil with the mid-ball lock ring 85, the flange **85*a* of the mid-ball lock ring 85 is no longer held aft relative to the locking sleeve 66 by the shoulder 93 of the gun housing 10, and is moved toward the abutments 89 on the locking sleeve 66 by the wave spring 90. The balls 82 are cammed inwardly by the aft edge of the annular groove 88 and are locked into the annular groove 84 in the forward cam 48 by the rear bore cylindrical surface 87 of the mid-ball lock ring 85, thereby fixing the forward cam 48 to the barrel extension 18. Rearward movement of the barrel extension 18 also moves the abutments 78 rearward, permitting the wave spring 102 to urge forward ball lock ring 79 aft and the corresponding balls 99 inward against the forward cam external cylindrical surface 83. When the barrel extension 18 has moved aft approximately one-half of the stroke of cam track 20, the shoulder 101 passes aft of the balls 99, allowing the balls 99 to move inward against the reduced diameter external cylindrical surface 100 and the forward lock ring 79 to move aft so that the balls 99 are locked inward by the forward bore internal surface 96 of the lock ring 79. The cylindrical surface 100 of the cam 48 extends longitudinally and thereby permits continued recoil (aft) motion of the cam 48 and the barrel extension 18. A short distance forward of the point at which the humps 116 and 117 of the forward cam pass by the rear of cam followers 22 and 46, the shoulder 108 of the annular groove 156 in the barrel extension 18 passes aft of the balls 104 located in the radial bores 103 in the forward rotor 12. The sear spring 112 pushes the toggle links 111 into their locked position, rotating the sear yoke 110 to move its toe 158 forward to push the aft ball lock ring 105 forward, camming the balls 104 into place in front of shoulder 108. The cam followers 22 and 46, driven by the momentum of the rotors of the gun, pass around the humps of the cam track 20, and the forward cam 48, urged by the barrel spring 58 in train through the spring plate 56, the barrel stop 52, the barrel 16, the barrel extention 18, the locking sleeve 66, and the mid-ball lock balls 82, starts to move forward. When the aft balls 104 engage the shoulder 108 of the barrel extension 18, they halt further forward motion of the barrel extension and the forward cam 48, and through the interaction of the cam followers 22 and 46 in the cam track 20, halt the forward rotor 12, thereby stopping the bolt drive and ammunition feed mechanisms of the gun with the barrel spring 58 compressed to nearly its fullest extent. The gun has thus been placed in its charged, or seared, position so that subsequent energizing of the solenoid 113** will cause firing to resume. The bolt has been unlocked and the fired cartridge case has been withdrawn approximately two-thirds of the distance to the rear dwell of the bolt drive mechanism.

To initiate firing of the seared, or charged, gun, the solenoid 113 is energized, to overcome spring 112, and to release the toggle links 111 and the yoke 110, and to move the toe 158 away from the aft ball lock ring 105. The compressed barrel spring 58 urges the barrel extension 18 forward, with the shoulder 108 camming the balls 104 outwardly and thereby the aft ball lock ring 105 rearwardly to the released position. Forward motion of the forward cam 48, which remains locked to the barrel extension 18 by the mid-ball lock balls 82, forces the cam surfaces 118 and 119 of the cam track 20 against the cam followers 22 and 46, providing angular acceleration of the forward rotor 12 and, the rotor, by means of tubular shafts 32 and gears 33, accelerates the remainder of the gun mechanism. The acceleration continues until the forward ball lock balls 99, which are riding on the surface 100, engage the shoulder 101 on the forward cam 48, after which the cam shoulder, through the forward ball lock balls 99, drives in train the rear spring sleeve 92, the spring ring 60, and the barrel spring 58 forward. The barrel spring 58 is held compressed by approximately one-half of its operating stroke (one-half of the stroke of the forward cam) while the entire mechansim coasts, driven by the kinetic energy in its moving parts. When the gun bolt assembly 24 reaches its rear dwell position, the forward cam 48 and the barrel extension 18 reach their battery position. Just before battery position is reached, the flange **85*a* of the mid-ball lock ring abuts the shoulder 93 in the gun housing and is held against the urging of wave spring 90 while the barrel extension 18 and the locking sleeve 66 continue forward to battery, carrying the mid-ball lock balls 82 into alignment with the annular groove 88 of the mid-ball lock ring 85, so that the balls 82 are cammed by the aft shoulder of the annular groove 84** of the forward cam into the annular groove 88 to unlock the forward cam 48 from the locking sleeve 66. The forward cam 48 is thus free to subsequently move aft independently of the barrel extension and barrel which are halted against the abutments 63 of the housing. Continued rotation of the forward rotor 12 carries the cam followers 22 and 46 past the 180° point and 0° point respectively on the cam track 20, whereupon the forward cam, being urged rearwardly by the barrel spring 58 acting in train through the spring plate 60, the rear spring sleeve 92 and the forward ball lock balls 99, brings the camming surfaces 115 and 114 into contact with the followers 22 and 46 respectively. The barrel spring accelerates the forward cam 48 rearwardly, the cam and follower interaction against accelerating the forward rotor 12 and, thence, the drive mechanism for the bolt assembly. Said acceleration is timed by the cams and gears of the gun to coincide with the acceleration of the bolt assembly forward from the rear dwell position. As the spring ring 60 nears the shoulder 64 of the forward gun tube 36, the forward ball lock ring 79 strikes the abutments 78 of the locking sleeve 66. The remainder of the rearward motion of the rear spring sleeve 92 carries the balls 99 into alignment with the enlarged rear bore cylindrical surface 97 of the lock ring 79 so that the balls 99 are free again to be cammed outwardly upon engagement with the shoulder 101 of the forward cam 48. The spring ring 60 reaches and is halted by the shoulder 64 of the forward gun tube 36, and the gun mechanism coasts to battery position. powered by the kinetic energy of the bolt assembly and forward and aft rotors. During the coasting period, the forward cam 48, driven by the cam followers 22 and 46, is moved rearward through the remainder of its recoil stroke and then forward to battery position, at which point the components of the gun mechanism have returned to the same positions as were occupied at the time of firing of the previous cartridge.

Firing of the next cartridge causes the gun barrel to recoil again, driving the mechanism to the seared, or charged, position again. If the solenoid has been deenergized, the gun mechanism halts agains at its seared position, from which it may be restarted by re-energizing the firing solenoid. If the solenoid remains energized, however, the gun mechanism continues to cycle and fire succeeding cartridges.

In summary, the forward cam 48 serves to convert reciprocation of the barrel extension 18 to rotation of the forward rotor 12. The forward rotor 12, which is engaged with the forward cam 48, rotates throughout the full gun cycle while the barrel extension reciprocates through its full cycle of recoil and counter-recoil during the first half of the gun cycle. Thus it is desirable to decouple the forward cam 48 from the barrel extension 18 during the second half of the gun cycle. It is also described to be able to dry-cycle the gun mechanism without reciprocation of the barrel extension. The mid-ball lock 85 assembly serves to couple/decouple the barrel extension 18 to the forward cam and includes the locking sleeve 66 which is clamped to the barrel extension, the mid-ball locking ring 85, the mid-balls 82 and the wave spring 90. It is also desirable to decouple the forward cam 48 from the barrel return spring 58 during the gun cycle. The forward ball lock 79 assembly serves to couple/decouple the forward cam to the barrel return spring 58 and includes the rear spring sleeve 92, the forward ball lock ring 79, the forward balls 99, and the wave spring 102.

After loading, but before firing, the gun mechanism is in battery, the first round is locked in the chamber, the barrel return spring 58 is uncharged, and the barrel extension 18 is not locked to the forward cam 48. Upon firing, the barrel extension recoils aft, and after approximately 8% of total travel, the mid-ball lock assembly locks the forward cam to the barrel extension, by means of the extension pushing the mid-ball lock sleeve 66 aft, relative to the housing, so that the spring 90 urges the ring 85 forward relative to the sleeve which cams the mid-balls 82 inwardly to lock the sleeve 66 to the cam 48. Full recoil travel is undergone with the extension driving the sleeve which pushes the cam aft. During counter-recoil, the sleeve by means of the mid-balls pulls the cam back to its battery position and then unlocks the mid-ball lock assembly to disengage the cam from the extension. Meanwhile, after the barrel extension upon firing has recoiled aft approximately 40% of its total travel, the shoulder 101 passes under the forward balls 99 and the spring 102 urges the forward lock ring aft to cam the balls 99 inwardly onto the surface 100, and the barrel extension completes its travel in recoil. The barrel extension then goes into counter-recoil, and after approximately 60% of its total travel, the shoulder 101 abuts the forward balls 99 to thereby engage and push forwardly the rear spring sleeve 92, which in turn pushes the aft end of the barrel spring 48 forward of the annular web 63 of the housing for the remainder of its travel in recoil at the same velocity as that at which the forward end of the spring is traveling to maintain the compression of the spring which was created by the initial 60% of recoil travel of the barrel extension. The barrel spring then urges aft the forward cam, which has been unlocked from the barrel extension, discharging its stored energy during the beginning of the second half of the gun cycle into the forward cam which converts it into rotation of the forward rotor. During this second half of the gun cycle, the energy of the barrel spring is supplemented by the energy of the recoil converter mechanism disclosed in Ser. No. 403,121, supra. The return of the aft end of the barrel spring to the housing stop during the second half of the gun cycle shifts the forward balls to disengage the rear spring sleeve 92 from its abutment with the shoulder 101 of the forward cam.

What is claimed is:

1. A gun having a cycle of operation and comprising:
a housing;
gun barrel means journaled for reciprocation relative to said housing;
an operating mechanism including means journaled for rotation relative to said housing and rotating continuously through said cycle of said gun;
motion conversion means for converting reciprocation to rotation; and
coupling means for coupling said motion conversion means to and between said gun barrel means and said operating mechanism for less than the totality of said cycle of operation of said gun.

2. A gun according to claim 1 further including:
a first stop fixed to said housing;
a second stop fixed to said gun barrel means;
a barrel return compression spring captured between said first and second stops and having
its forward end thereof releasably abuting said first stop, and
its aftward end thereof releasably abuting said second stop;

third stop means for abuting said aftward end of said barrel spring; and coupling means for releasably coupling said third stop means to said motion conversion means at a predetermined point in the forward reciprocation of said barrel means whereby said third stop means in forced forward with the aft end of said spring at the same velocity as said second stop.

3. A gun according to claim 1 wherein:

said operating mechanism, when coupled to said third stop means by said coupling means, carries said third stop means forward of said first stop, whereby said third stop means forces said aft end of said barrel spring forward of and away from said second stop.

4. A gun according to claim 3 wherein:

when said first stop halts, said aft end of said barrel spring moves aftwardly and carries said third stop means aftwardly, thereby driving said operating mechanism, until said aft end of said barrel spring abuts said first stop; further including additional means for uncoupling said third stop means from said operating mechanism when said aft end of said barrel spring abuts said first stop.

5. A gun according to claim 4 wherein:

said operating mechanism includes a cam journaled for reciprocation with respect to said housing, a cam track on said cam, and a rotor journaled for rotation with respect to said housing and having a cam follower engaged by said cam track;

said third stop means comprises a sleeve journaled for reciprocation on said cam and having a plurality of radial bores in which are respectively disposed a like plurality of balls;

recess means in said cam for receiving a portion of each of said balls and having shoulder for abuting said received portion of said balls for permitting said cam to drive said sleeve in the forward direction and said sleeve to drive said cam in the aftward direction, and ball lock means carried by said sleeve and having two positions, a first position for clearing said balls wherein said balls are free to move to clear said recess means in said cam, and a second position for camming said balls wherein said balls are forced to enter in part said recess means in said cam.

6. A gun according to claim 1 wherein:

said gun barrel means has a cycle of reciprocation which has a period which is shorter than the period of said cycle of operation of said gun; and said coupling means couples said motion conversion means during said period of said cycle of reciprocation of said gun barrel means.

7. A gun according to claim 6 wherein:

said coupling means includes a clutch operated by the travel of said gun barrel with respect to said housing.

8. A gun according to claim 6 wherein:

said continuously rotating means of said operating means includes a rotor having a cam follower;

said motion conversion means includes a cam journaled for reciprocation with respect to said housing, a cam track on said cam engaging said cam follower of said rotor;

said coupling means includes a clutch operated by the travel of said gun barrel means with respect to said housing to couple and uncouple said cam to said gun barrel means for concomitant reciprocation therewith.

9. A gun according to claim 8 wherein:

said clutch includes:

a locking sleeve fixed to said gun barrel means and having a plurality of radial bores in which are respectively disposed a like plurality of balls;

recess means in said cam for receiving a portion of each of said balls in which disposition said cam is locked to said sleeve;

ball lock means carried by said sleeve and having two positions, a first position for clearing said balls wherein said balls are free to move to clear said recess means in said cam, and a second position for camming said balls wherein said balls are forced to enter in part said recess means in said cam;

spring means for urging said ball lock means to said second position thereof; and stop means fixed relative to said housing for engaging said ball lock means at a predetermined point of travel of said locking sleeve for forcing said ball lock means to said first position thereof.

10. A gun having a cycle of operation and comprising:

a housing mounted for reciprocation and having a first stop;

a gun bolt;

gun barrel means journaled for reciprocation relative to said housing and having a second stop;

and operating mechanism for driving said gun bolt;

means for coupling said gun barrel means to said operating mechanism whereby reciprocation of said gun barrel means drives said operating mechanism;

a barrel return compression spring captured between said first and second stops and having its forward end thereof releasably abuting said first stop, and its aftward end thereof releasably abuting said second stop;

third stop means, journaled for reciprocation in said housing, for abuting said aftward end of said barrel spring; and coupling means for releasably coupling said third stop means to said operating mechanism at a predetermined point in the forward reciprocation of said barrel means whereby said third stop means is forced forward at the same velocity as said second stop.

* * * * *